US005754095A

United States Patent [19]

Bader et al.

[11] Patent Number: 5,754,095

[45] Date of Patent: May 19, 1998

[54] TONE GENERATING CIRCUIT

[75] Inventors: Joseph F. Bader, Crete; Robert W. Wardzala, Downers Grove, both of Ill.

[73] Assignee: Federal Signal Corporation, University Park, Ill.

[21] Appl. No.: 540,848

[22] Filed: Oct. 11, 1995

Related U.S. Application Data

[63] Continuation of Ser. No. 56,294, Apr. 30, 1993, abandoned.

[51] Int. Cl.[6] ..... G10K 9/12

[52] U.S. Cl. ..... 340/384.7; 84/694; 84/697

[58] Field of Search ..... 84/622, 625, 627, 84/674, 678, 694, 695, 696, 697, 600, 659, 660; 340/384.7, 384.1, 384.71, 384.72, 384.73

[56] References Cited

U.S. PATENT DOCUMENTS

| | | | |
|---|---|---|---|
| 3,424,989 | 1/1969 | Erath et al. . | |
| 3,504,364 | 3/1970 | Abel . | |
| 4,001,816 | 1/1977 | Yamada et al. . | |
| 4,100,543 | 7/1978 | Stockdate et al. | 340/384.72 |
| 4,175,463 | 11/1979 | Deutsch . | |
| 4,204,200 | 5/1980 | Beyl, Jr. . | |
| 4,293,851 | 10/1981 | Beyl, Jr. . | |
| 4,363,028 | 12/1982 | Basnak | 340/384.72 |
| 4,401,975 | 8/1983 | Ferguson et al. . | |
| 4,486,742 | 12/1984 | Kudo et al. . | |
| 4,724,424 | 2/1988 | Nakashima et al. . | |

FOREIGN PATENT DOCUMENTS

| | | |
|---|---|---|
| 0 025 537 A1 | 3/1981 | European Pat. Off. . |
| 2 333 314 | 6/1977 | France . |
| 1 555 538 | 11/1979 | United Kingdom . |

*Primary Examiner*—John K. Peng
*Assistant Examiner*—Nathan J. Flynn
*Attorney, Agent, or Firm*—Leydig, Voit & Mayer, Ltd.

[57] ABSTRACT

A tone generating circuit for delivering power to a speaker modulated fourth harmonic audio square wave signal by its fundamental to produce a modulated audio signal within a selected frequency range. The tone generating circuit may be incorporated in a power delivering circuit that supplies a pulse width modulated audio signal to a speaker in one mode of operation, a fourth harmonic modulated audio signal in a second mode of operation, and a square wave audio signal in a third mode of operation.

27 Claims, 8 Drawing Sheets

TONE GENERATING CIRCUIT

This is a continuation of application Ser. No. 08/056,294 filed on Apr. 30, 1993 now abandoned.

FIELD OF THE INVENTION

The present invention relates to the electronic generation of audio frequency signals and in particular to an electronic circuit that provides high efficiency in operation using novel waveforms for the reproduction of audible tones within selected frequencies. The circuit may be implemented in an electronic siren amplifier which is used in an early warning or detection system.

BACKGROUND OF THE INVENTION

An electronic siren produces audio frequency signals which vary or sweep within a desired frequency range. The electronic siren typically includes an input signal source, an amplifier circuit and a loudspeaker. The ability of the amplifier circuit to adjust power output in these arrangements is desirable to mimic the reproduction of a mechanical siren. However, the physical limitations of the loudspeaker and other circuit elements prevent the application of signals of low frequency and long durations which are beyond the safe operating region of power versus the frequency of the electronic loudspeaker, as loud speakers are damaged with excessive power levels below the cut off frequencies of the horn or driver of the electronic loudspeaker.

Known electronic sound systems typically produce a sine wave input signal that is passed to the amplifier circuit and thereafter to the loudspeaker. Conventional electronic reproduction of siren tones, however, results in inefficiencies when using sine wave input and resultant output signals. Inasmuch as the amplifier circuit in these arrangements is comprised of active devices which operate in the active region, large quantities of energy are dissipated therein during operation. The use of such arrangements is therefore undesirable, particularly when the preferred or only available power is supplied to the unit with a fixed capacity power source, such as a battery.

Accordingly, conventional electronic sirens employ the use of a square wave input signal to improve the efficiency of the unit. In these arrangements, the active devices in the amplifier circuit operate as switches in the saturation region. In order to vary output power of an electronic siren that receives a square wave input signal, the voltage supplying the active devices must be varied. Because of the difficulty in efficiently varying supply voltage, such square wave amplifiers are usually operated at a fixed voltage (and therefore power which changes only as a function of the impedance of the horn/driver combination) output.

Both the sine wave and square wave technologies are also characterized by the traditional audio principle of increasing power resulting in proportional increase in audio output. In certain applications, such as in the emergency signaling market, it is desirable either from a warning standpoint or from an equipment reliability standpoint to economically vary the power levels while maintaining a square wave waveform to achieve high efficiencies and preserve battery life.

SUMMARY OF THE INVENTION

It is therefore a principle object of the invention to overcome the deficiencies of the prior art.

It is more particularly an object of the present invention to provide increased speaker efficiency in an electronic siren at reduced cost.

It is a further object of the present invention to provide improved operating characteristics in an electronic siren used in a commercial setting.

It is another object of the present invention to provide increased audio output in an electronic siren without concomitant increase in power output.

It is yet a further object of the invention to provide audio signals having modified waveshapes to maximize the audio output of an electronic siren over an operating range of frequencies.

It is another object of the present invention to find improved low frequency siren tones without damaging the mechanical or electrical components of a speaker.

The present invention provides these and other additional objects through an improved electronic amplifier circuit provides improved efficiency and audio output in an electronic siren system. A tone generating circuit according to the present invention provides an audio output signal to a speaker. The tone generating circuit includes a first circuit, a second circuit, a modulator circuit connected to the first circuit and the second circuit and an amplifier circuit connected to the modulator circuit. The first circuit generates a first square wave signal having a frequency four times the desired audio frequency. The second circuit generates a second square wave signal with a frequency one-fourth that of the first signal. The modulator circuit modulates the second (lower frequency) audio signal with the first (higher frequency) signal to produce a fourth harmonic modulated audio signal. This audio signal provides increased audio output at selected frequencies of operation.

In another embodiment, the tone generating circuit is integrated in a power delivering circuit that supplies power to a loudspeaker. The power delivering circuit operates in various modes depending on the frequency of an input signal. The power delivering circuit includes a square wave signal generator for generating a square wave input signal. A first circuit receives the square wave input signal and provides a fourth harmonic modulated audio signal in a first frequency range. A second circuit receives the square wave input signal and provides a square wave audio signal in a second frequency range. A selector circuit connected with the first circuit and second circuit passes the modulated audio signal in a first mode of operation. In a second mode, the selector circuit passes the square wave audio signal. Desirably, the power delivering circuit also includes a duty cycle adjustment circuit for synthesizing low frequency audio signals without damaging the speaker and for equalization. The power delivering circuit also includes an output circuit connected to the selector circuit that receives the modulated audio signal in the first mode and the square wave audio signal in the second mode.

BRIEF DESCRIPTION OF THE DRAWINGS

The above describes an additional objects and features of the present invention may be further understood by reference to the following detailed description of the preferred embodiment taken in conjunction with the accompanying drawing of which.

DETAILED DESCRIPTION OF THE PREFERRED EMBODIMENT

According to the present invention, a tone generating circuit provides a fourth harmonic modulated audio signal within a selected frequency band. This fourth harmonic modulated audio signal is supplied to a speaker to provide improved efficiency and audio output in the speaker, particularly for lower frequency signals.

Figure 1:
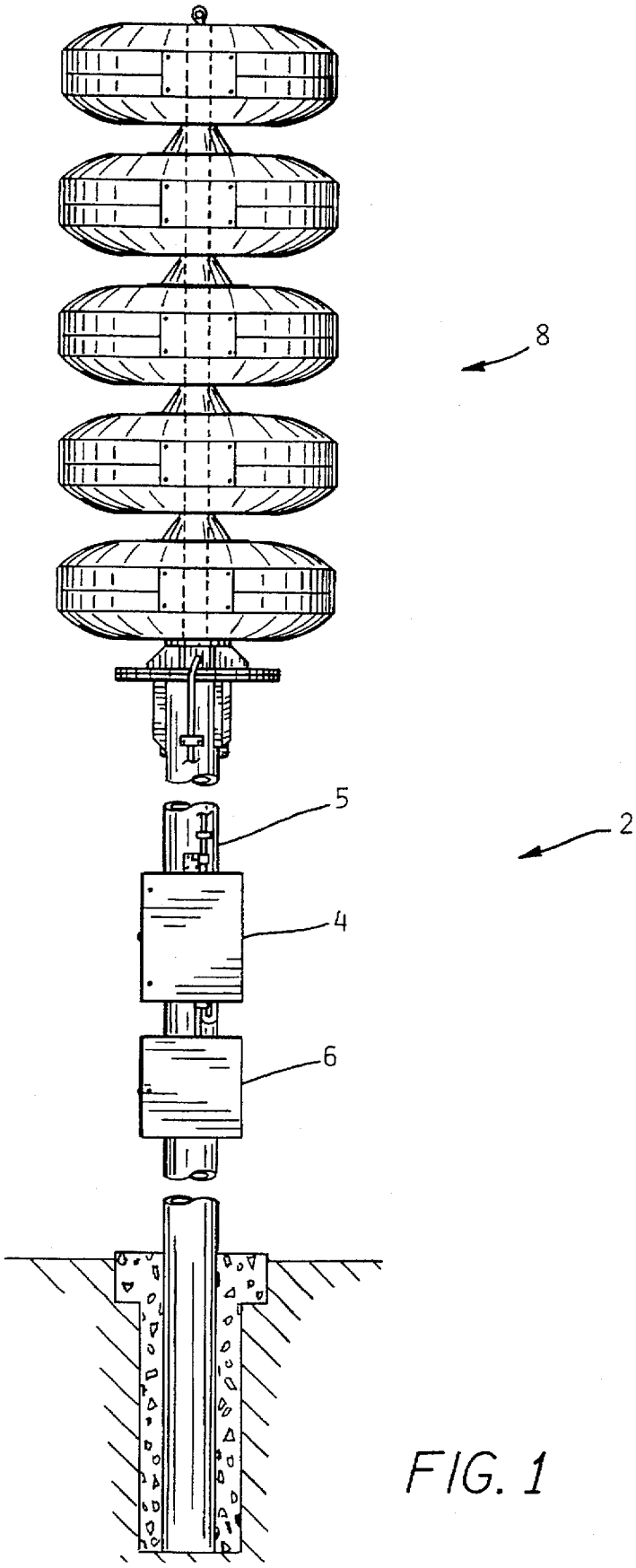
FIG. 1 is a section view of a tone generating circuit of the present invention used in conjunction with a speaker array in one implementation of the present invention.

FIG. 1 shows an electronic warning siren 2 with certain details removed for clarity. The electronic warning siren 2 includes a control section 4 mounted to a pole 5 or other suitable support. The control section 4 comprises a tone generator and amplifier circuit according to the present invention, as described hereinafter. The control section 4 receives power from a power unit 6, such as a battery. The control section 4 supplies output signals to a speaker array 8, such as the speaker array described in U.S. Pat. No. 5,146,508, incorporated herein by reference. Those skilled in the art will appreciate that the control section 4 may receive and supply control and data signals from a remote location. The invention, however, may also be employed in other applications with appropriate modification. For example, the invention may be utilized in other warning applications such as in a fire panel application in a commercial setting. The invention may likewise be used for, general paging applications wherein a hi-fidelity speaker, tone generator and amplifier circuit are contained within a hand-held enclosure. In addition, those skilled in the art will appreciate that tone generation may be created by oscillator circuitry or with use of a microprocessor and associated circuitry which provides signals in a distributed system using the present invention. Likewise, the circuitry described hereinafter may be utilized to supply output signals to either direct radiator-type speakers or compression-type drivers such as those used in the speaker array shown in FIG. 1.

Figure 2:
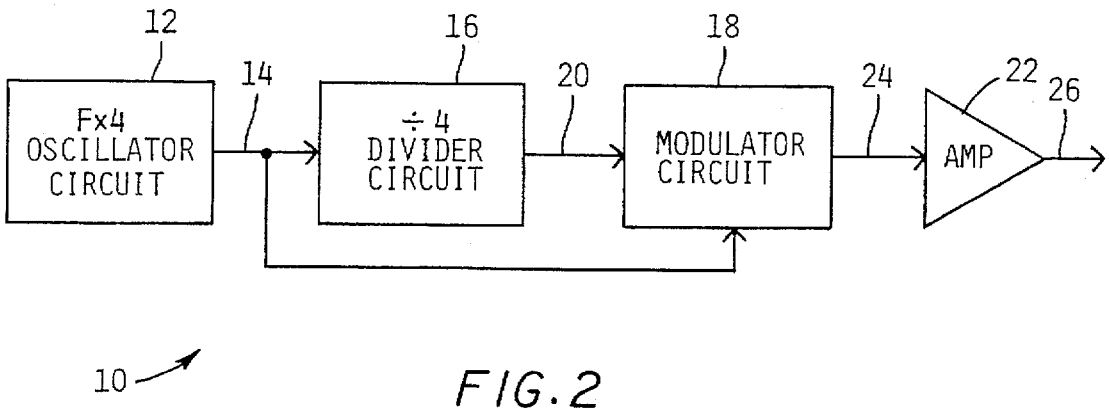
FIG. 2 is a block diagram representation of a tone generating circuit for producing increased audio output for selected frequencies.
Figure 6:
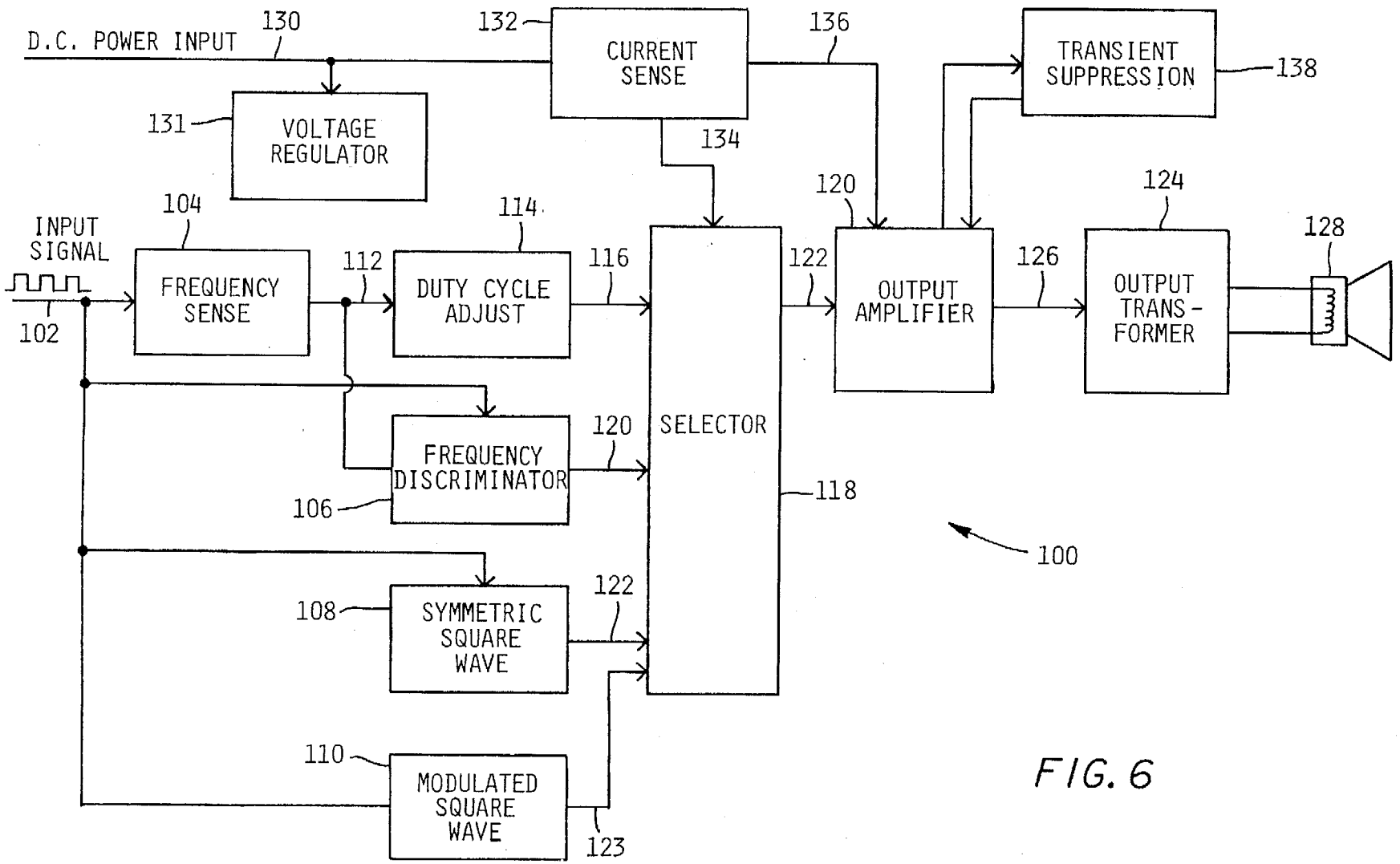
FIG. 6 is a block diagram representation of an alternative embodiment of a power delivering circuit that utilizes the tone generating circuit of FIG. 2.

FIG. 2 depicts a simplified block diagram representation of a tone generating circuit 10 used to supply an audio signal to a loudspeaker (such as the loudspeaker shown diagrametrically in FIG. 6). The tone generating circuit 10 includes an oscillator circuit 12 that operates at four times the fundamental frequency of the desired audio signal to be created. The oscillator circuit 12 operates at either a fixed frequency or at a varying frequency preferably within a range less than one-third of four times the −3 dB upper frequency limit of the speaker being utilized, as described in further detail below. The oscillator circuit 12 supplies a high frequency output signal on a line 14 to a divider circuit 16. The divider circuit 16 divides the signal by a factor of four and supplies a square wave audio signal to a modulator circuit 18 on a line 20.

The modulator circuit also receives the high frequency signal on the line 14 to modulate the fourth harmonic by its fundamental. The modulator circuit 18 supplies a modulated audio signal to an amplifier 22 on a line 24. In this way, an enhanced audio signal is supplied to the loudspeaker on a line 26. As described below, this arrangement generates additional on axis sound pressure without increasing input power within a selected frequency range (depending on the operating characteristics of the loudspeaker).

Figure 3A:
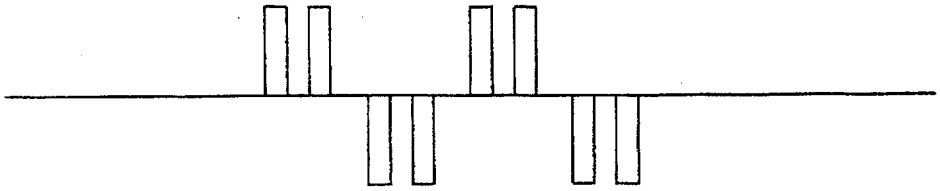
FIG. 3A shows a modified square wave signal produced by the tone generating circuit of FIG. 2.
Figure 3B:
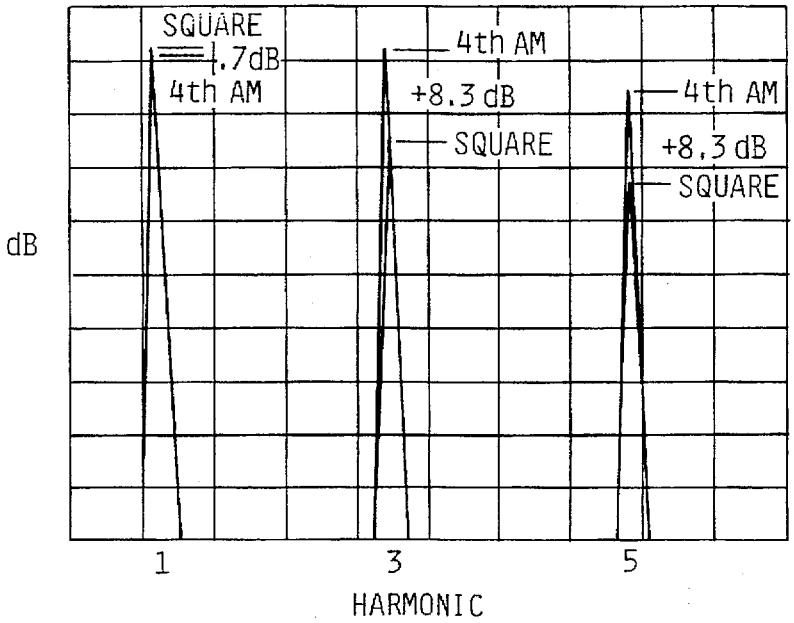
FIG. 3B shows the Fourier series produced by modified square wave signal of FIG. 3A in comparison with a square wave signal.

FIG. 3A is a graphical representation of the audio signal on line 26 of FIG. 2 generated by fourth harmonic modulation shown as a function of time. FIG. 3B shows a comparison of the Fourier series generated by this signal with a square wave signal. As shown therein, the invention shifts power from the first harmonic and higher harmonics of the audio signal supplied to the speaker at lower frequencies into the third and fifth harmonics. Inasmuch as most horn speakers are most efficient in their midband of operation, accentuation of the third and fifth harmonics by fourth harmonic modulation enables the speaker to operate in a more efficient frequency range and thereby boost the effective power of the speaker at its low end of operation. The fundamental decreases by approximately 1 dB. However, both the third and fifth harmonic increase by approximately 8.3 dB. This shift of higher harmonic content into the signal results in increased audio output for the applied power. In addition, the change in pitch tone is difficult to perceive, particularly in outdoor warning siren systems wherein signal fidelity is typically not as critical as audio output. Such a result is advantageous, particularly in electronic siren systems such as the arrangement shown in FIG. 1 wherein a fixed power supply is utilized and sound quality is less important than efficient use of power.

Figure 3C:
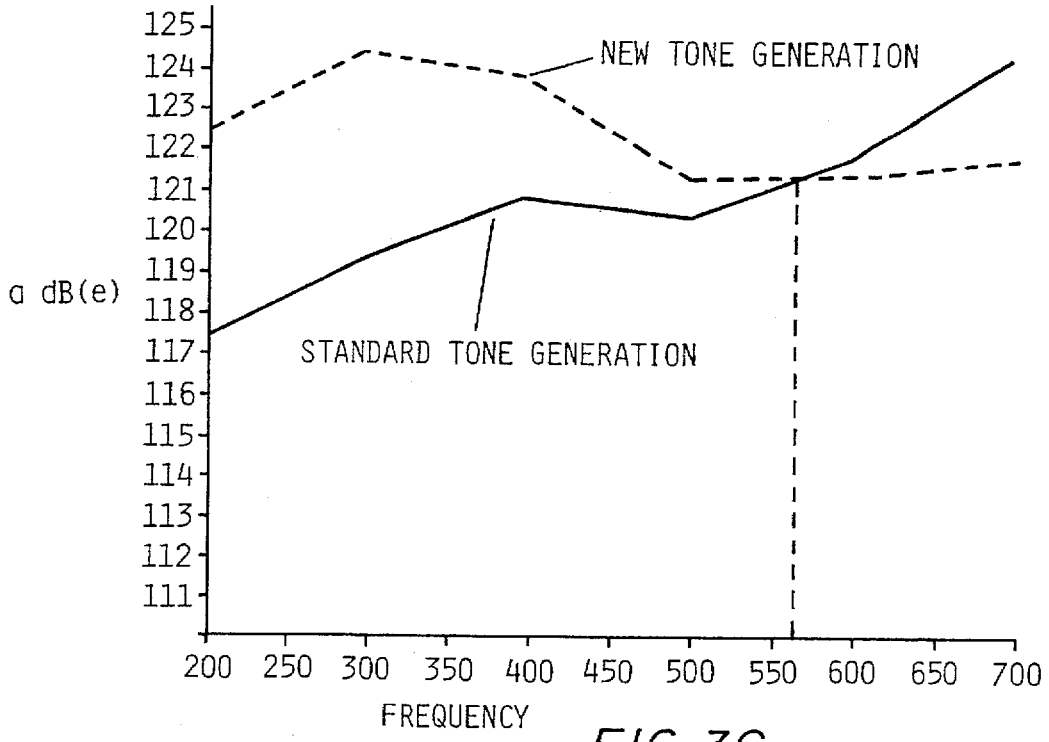
FIG. 3C shows the audio output in a loudspeaker using the modified square wave signal of FIG. 3A in comparison with a square wave signal in the C-weighted scale.

FIG. 3C illustrates a comparison of the frequency response of a speaker driven by the fourth harmonic modulated audio signal of FIG. 3A in comparison with a standard square wave audio signal. At lower frequencies, the harmonic content of the modulated audio signal provides increased audio output. Due to the higher harmonic content of the modulated audio signal, the audio output rolls off at increased frequencies. As shown in FIG. 3C, the audio output eventually reaches a cross-over frequency wherein the standard square wave audio signal provides greater audio output. This cross-over frequency corresponds approximately to one-third the −3 dB upper frequency limit of the speaker array being used. FIG. 3C represents actual audio output measurements taken on the "C" weighted scale using a LH1-type speaker, manufactured by University Sound, Oklahoma City, Okla. For such a speaker, the cross-over frequency is approximately 555 Hz. Those skilled in the art will appreciate that if a different speaker is utilized, the cross-over frequency may correspond to a different frequency. Likewise, the same speaker may have different cross-over frequency for a different weighted curve. The advantages of using the present invention below the cross-over frequency, however, remain the same.

Figure 4:
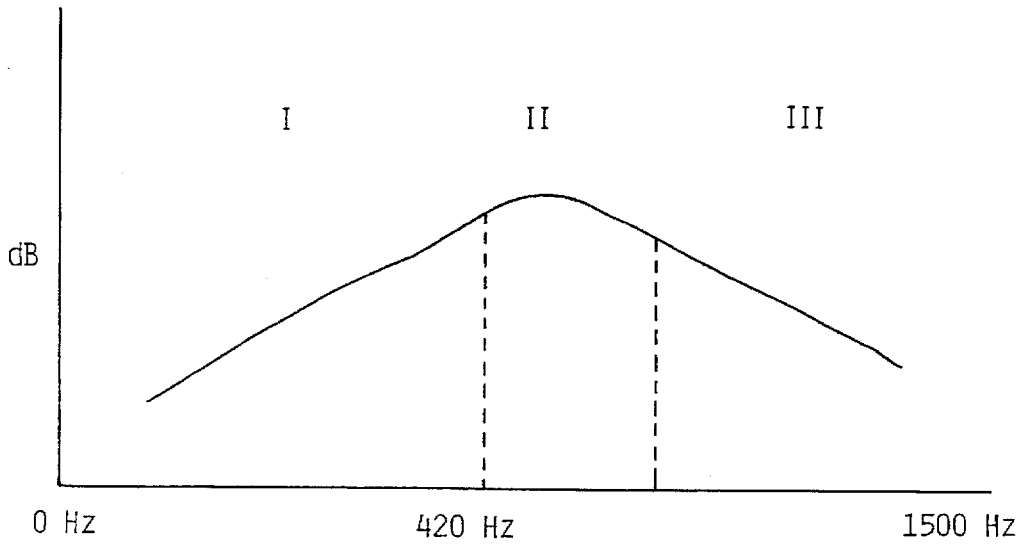
FIG. 4 is a graphical representation of audio output of a typical loudspeaker as a function of frequency.

FIG. 4 is a graphical representation of the frequency response of the audio output of a typical electronic speaker array, such as the array shown in FIG. 1. As shown therein, at lower range frequencies corresponding to Region I, the efficiency of the speaker increases as frequency rises. In addition, the speaker is susceptible to damage with the application of excessive power levels below the "cutoff" frequency of the horn or driver of the loudspeaker. As described below in conjunction with FIGS. 6 and 7A–7C, the present invention provides for the application of fourth harmonic modulated square wave audio signals, such as the signal depicted in FIG. 3A in order to inject a higher harmonic content into the audio signal. In order to provide less power to the driver, the duty cycle of the modulated square wave signal is adjusted in order to decrease the power level at lower frequencies prolong the useful life of the driver. At frequencies below some cross-over frequency typically near the midband of operation, the invention provides for the application of fourth harmonic modulated square wave signals to the loudspeaker with a symmetrical duty cycle. For the embodiment shown in FIGS. 6 and 7A–7C, this cross-over frequency corresponds to 420 Hz. In Region II, the audio output of the speaker is somewhat higher than that in Region III, where the output rolls off due to the inductance in the speaker driver. Likewise, the advantages of utilizing fourth harmonic modulated signals is reduced and eventually reaches the cross-over frequency wherein the application of square wave signals provides greater efficiency. Accordingly, the invention provides for the application of a square wave input signal to the loudspeaker above the cross-over frequency, as described below. The square wave signal may be pulse width modulated in Region II to restrict power output in Region II in order to equalize the frequency response of the speaker.

Figure 5:
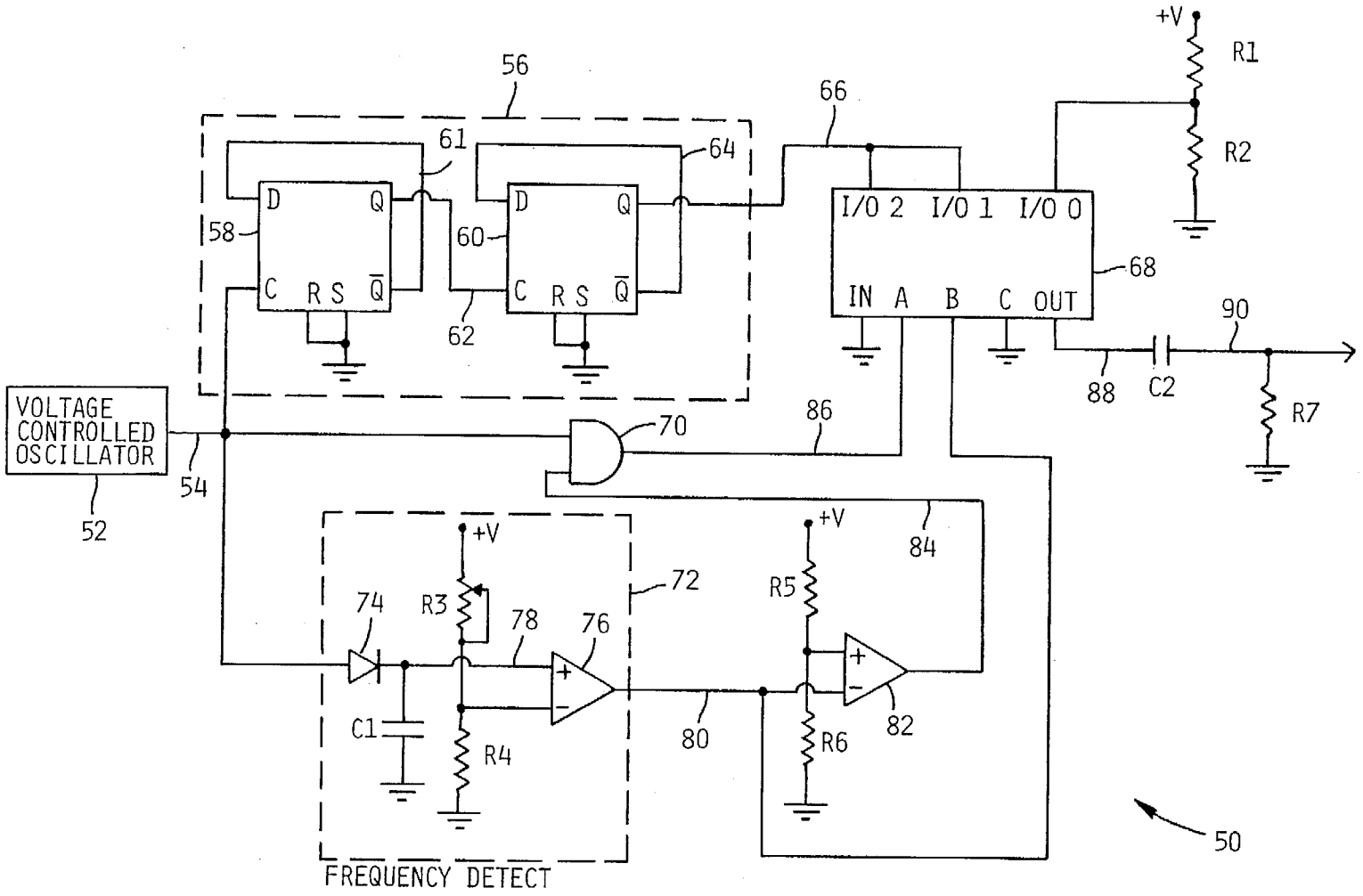
FIG. 5 an electrical circuit diagram of a power delivering circuit that utilizes the tone generating circuit of FIG. 2 in one mode of operation.

FIG. 5 shows one implementation of a power delivering circuit 50 according to one embodiment of the present invention. The circuit 50 selects either a fourth harmonic modulated audio signal or a square wave audio signal based on the frequency of the audio signal to be supplied to a speaker. For lower operating frequencies, the circuit 50 applies a fourth harmonic modulated square wave signal to inject power into the higher harmonics of the signal, namely the third and fifth harmonics, while reducing the power in the first harmonic which is in a less efficient operating range of the speaker, as described in conjunction with FIGS. 3A–3C. In the embodiment shown in FIG. 5, the power delivering circuit applies a standard square wave audio signal above a cross-over frequency of the input signal, as shown generally in FIG. 3C.

The power delivering circuit 50 includes a voltage controlled oscillator 52 that operates at four times the intended fundamental frequency of the audio signal to be generated. The oscillator 52 typically varies its output signal to create a siren tone and provides a square wave output signal on a line 54 to a divider circuit 56 including first and second D-type flip-flops 58 and 60. In particular, the square wave output signal on line 54 is supplied to the clock input of the first D flip-flop 58. The D input of flip-flop 58 is connected to the Q' output via a line 61. The Q output of flip-flop 58 supplies an output signal one half the frequency of the signal on line 54 on a line 62 to the clock input of flip-flop 60. As with flip-flop 58, the D input of flip-flop 60 is coupled with the Q' output on a line 64. The flip-flop 60 supplies an output signal from the Q output on a line 66. This output signal is a square wave signal having a frequency reduced by a factor of four.

This square wave signal is thereafter applied to the second and third input terminals (I/O1 and I/O2) of a demultiplexer circuit 68 via line 66. The first input terminal (I/O0) of demultiplexer circuit 68 is coupled to a constant positive voltage via voltage divider circuit including resistors R1 and R2. The voltage applied to the first input terminal has a magnitude one-half the peak-to-peak value of the generated audio signal. When the first and second input terminals I/O0 and I/O1 are switched at a rate four times the fundamental, a fourth harmonic modulated output signal is provided at the output terminal of demultiplexer circuit 68.

The square wave signal on line 54 is also applied to one input of an AND gate 70 that operates to disable the square wave audio signal applied to select input terminal A at frequencies above the cross-over frequency as described below. Likewise, the signal on line 54 is applied to a frequency detector circuit 72. The signal on line 54 is passed through a diode 74 to the noninverting input terminal of a comparator 76 on a line 78. A capacitor C1 coupled between line 78 and ground provides an increased positive voltage on line 78 as the frequency of the signal applied on line 54 increases. A threshold voltage corresponding to the cross-over frequency for applying a square wave output signal to the speaker rather than a fourth harmonic modulated signal is applied to the inverting input terminal of comparator 76 via a voltage divider circuit including resistors R3 and R4. Accordingly, when the signal corresponding to the frequency of the input square wave signal exceeds the threshold voltage, a signal at the output terminal of comparator 76 appears as a constant high voltage. On the other hand, when the signal corresponding to the frequency of the input square wave signal is less than the threshold, a signal at the output of comparator 76 appears as a low voltage.

This signal is supplied to a second input select terminal B of the demultiplexer circuit on a line 80. Likewise, the signal appearing at line 80 is supplied to the inverting input terminal of a comparator 82. A positive threshold voltage is applied to the noninverting input terminal of comparator 82 via a voltage divider circuit including resistors R5 and R6. When the magnitude of the signal appearing at the inverting input terminal of comparator 82 exceeds the threshold value, a signal at the output terminal of comparator 82 appears as a low voltage. On the other hand, when the magnitude of the signal appearing at the inverting input terminal of comparator 82 is less than the threshold value, a signal at the output terminal of comparator 82 appears as a high voltage.

This output signal is provided to the second input terminal of the AND gate 70 on a line 84. As noted above, the AND gate 70 also receives the input square wave signal on line 54. The AND gate 70 operates to disable the square wave input signal on line 54 for operating frequencies above the cross-over frequency. In particular, the AND gate 70 logically ANDs the input square wave signal on line 54 with the signal on line 84 corresponding to a high frequency disable and thereafter applies the resulting signal to the first input select terminal A of demultiplexer 68 on a line 86. As described above, the second input select terminal B receives a signal on line 80 corresponding to a selected frequency cutoff. The third input select terminal C is coupled to ground. A table illustrating the inputs and resulting signal for the demultiplexer circuit 68 is shown below in Table I:

TABLE I

| Input | | |
|---|---|---|
| A | B | Out |
| 0 | 0 | I/O 0 (modulated output signal) |
| 0 | 1 | I/O 2 (square wave output signal) |
| 1 | 0 | I/O 0 (modulated output signal) |
| 1 | 1 | — |

Thus, the demultiplexer circuit 68 selects the signal appearing at the third input terminal I/O2 when the signal appearing at input select terminal A is low and the signal at terminal B is high. An output signal is provided on a line 88 which is a square wave audio signal having a frequency one-fourth the frequency of the input signal on line 54. On the other hand, when the signal appearing at the second input select terminal B is low, an audio signal is provided at line 88 having a waveshape similar to that of the signal depicted in FIG. 3A inasmuch as the input signal applied select input terminal A operating at four times the fundamental switches between input terminals I/O0 and I/O1. This signal generated on line 88 is passed through capacitor C2 as an output signal on a line 90. A resistor R7 may be placed between line 90 and ground. The output signal on line 90 is thereafter applied to an amplifier circuit which drives a loudspeaker. Accordingly, the combination of the frequency divider circuitry and demultiplexer circuitry described above provides a pre-amplifier for an electronic siren system.

By way of example and not by way of limitation, the circuit components for the power delivering circuit of FIG. 4 may have values or types as shown in Table II:

TABLE II

| Reference Numeral | Value |
|---|---|
| R1, R2 | 2 kohms |
| R4, R5, R6 | 2.2 kohms |
| R3 | 5 kohms |
| C1 | .1 microfarads |
| C2 | 1 microfarad |
| 68 | IC 4051 |

FIG. 6 is a block diagram of another embodiment of the present invention that utilizes the tone generating circuit of FIG. 1 in one mode of operation. The embodiment shown in FIG. 6 corresponds to a circuit for implementing audio signals to a speaker having the output characteristics shown in FIG. 4. The circuit of FIG. 6 functions in a similar fashion to the circuit shown in FIG. 5 by applying a fourth harmonic modulated signal at frequencies less than a cross-over frequency to increase the audio output of the speaker. Similarly, the circuit shown in FIG. 6 applies a square wave signal at frequencies greater than the cross-over frequency. FIG. 6, however, also includes circuitry for adjusting the duty cycle of the audio output signal to control the output power supplied to the speaker or speaker array. Accordingly, this arrangement provides reduced output power at lower frequencies which prolongs the useful life of the driver. In addition, this arrangement provides for pulse width modulating the audio signal at midband frequencies (corresponding to Region II in FIG. 4) to flatten output power.

As shown in FIG. 6, an input square wave signal which has a frequency four times the desired frequency of audio signal to be generated is supplied to a power delivering circuit 100 on a line 102. The input signal is supplied to a frequency sensing circuit denoted by a block 104 on the line 102. The input signal is also supplied to a frequency discriminator circuit 106, a symmetrical square wave generating circuit 108 on the line 102, and a modulated square wave circuit 110 on the line 102. As described below, the square wave generating circuit 108 receives the signal on line 102 and provides an audio signal on a line 122 having a frequency one-fourth the frequency of the signal on line 102. The modulated square wave circuit 110 receives the signal on line 102 and provides a modulated audio signal on a line 123.

The frequency sensing circuit 104 senses the frequency of the input signal and supplies an output voltage signal via indicative of the input signal frequency on a line 112 to duty cycle adjustment circuitry denoted by a block 114. In addition, the frequency sensing circuit 104 supplies a signal on a line 112 to the frequency discriminator circuitry 106. In response, the frequency discriminator circuitry 106 provides control signals on a line 120 corresponding to frequency shift points. In the preferred embodiment, the frequency discriminator circuit 106 provides a first control signal for inhibiting an input signal for frequencies less than 25 Hz which could otherwise destroy the speaker. The frequency discriminator circuit 106 also provides a control signal corresponding to the sensing of the cross-over frequency for selecting a square wave signal rather than a fourth harmonic modulated signal. In the embodiment shown in FIGS. 6 and 7A–7C, the cross-over frequency is approximately 425 Hz.

In response to the frequency sensing signal on line 112, the duty cycle adjust circuitry 112 supplies an output signal via a line 116 to a selector circuit denoted by a block 118. In the preferred embodiment, the duty cycle may be adjusted for low frequency signals to reduce the power applied to the loudspeaker. The duty cycle is also adjusted at midband operating frequencies to tailor the applied audio signal with the operating characteristics of the speaker. As noted above, the frequency discriminator circuitry 106 also supplies control signals to the selector circuitry on line 120. In response, the selector circuit 118 thereafter selects an appropriate waveshape and provides an output signal to output drive transistors denoted by a block 120 on a line 122. In this way, the selector circuit 118 inhibits the passage of output signals less than 25 Hz. The selector circuit 118 passes fourth harmonic modulated audio signals with an adjusted duty cycle for input signals corresponding to a range from 25 to approximately 425 Hz. Above the cross-over frequency, the selector circuit 118 provides square wave output signals which may optionally be pulse width modulated in a selected frequency range to equalize the output power supplied on line 122. The output transistors thereafter supply a signal to an output transformer 124 on a line 126. The output transformer, in turn, drives a loudspeaker 128 in a manner known by those skilled in the art.

In the preferred embodiment, the power delivering circuit 100 also includes overload protection circuitry for a DC power input supplied on a line 130. The input on line 130 is provided to a current sensing circuit 132. While the current sensing circuitry 132 is shown in FIG. 6 as measuring DC current, those skilled in the art will appreciate that current may be sensed at the AC output as well. In addition, voltage regulating circuitry 131 provides power for the logic circuitry utilized in this embodiment as will be understood by those skilled in the art. The current sensing circuit 132 supplies a disable signal on a line 134 to the selector circuit 118. In addition, the current sensing circuit 132 supplies an output signal to disable the output drive transistors 120 on a line 136. The output transistor circuitry 120 may also include transient suppression circuitry denoted by a block 138 that suppress extraneous signals.

Figure 7A:
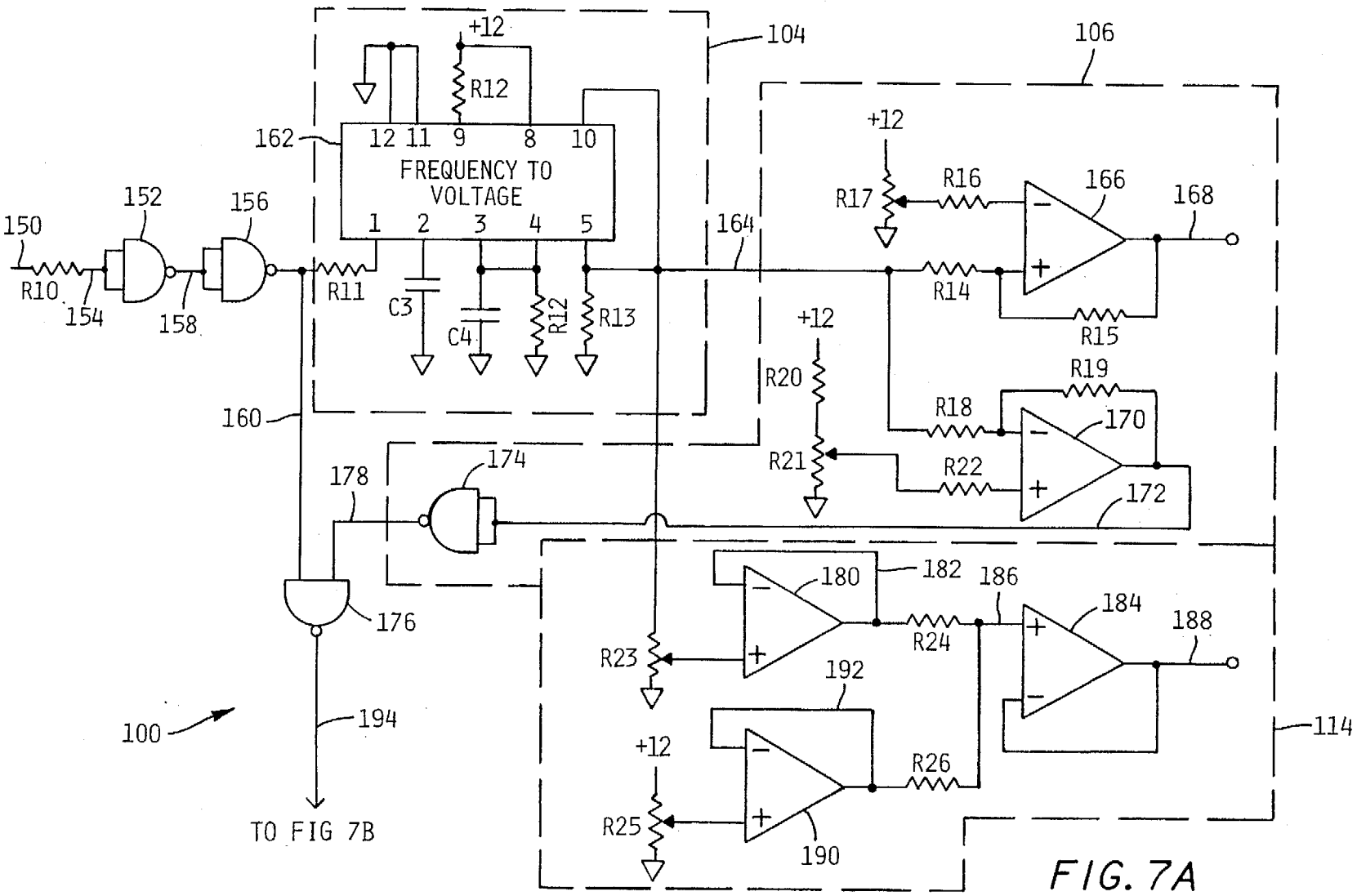
FIGS. 7A–7C illustrate an electrical schematic diagram of the power delivering circuit of FIG. 6.
Figure 7B:
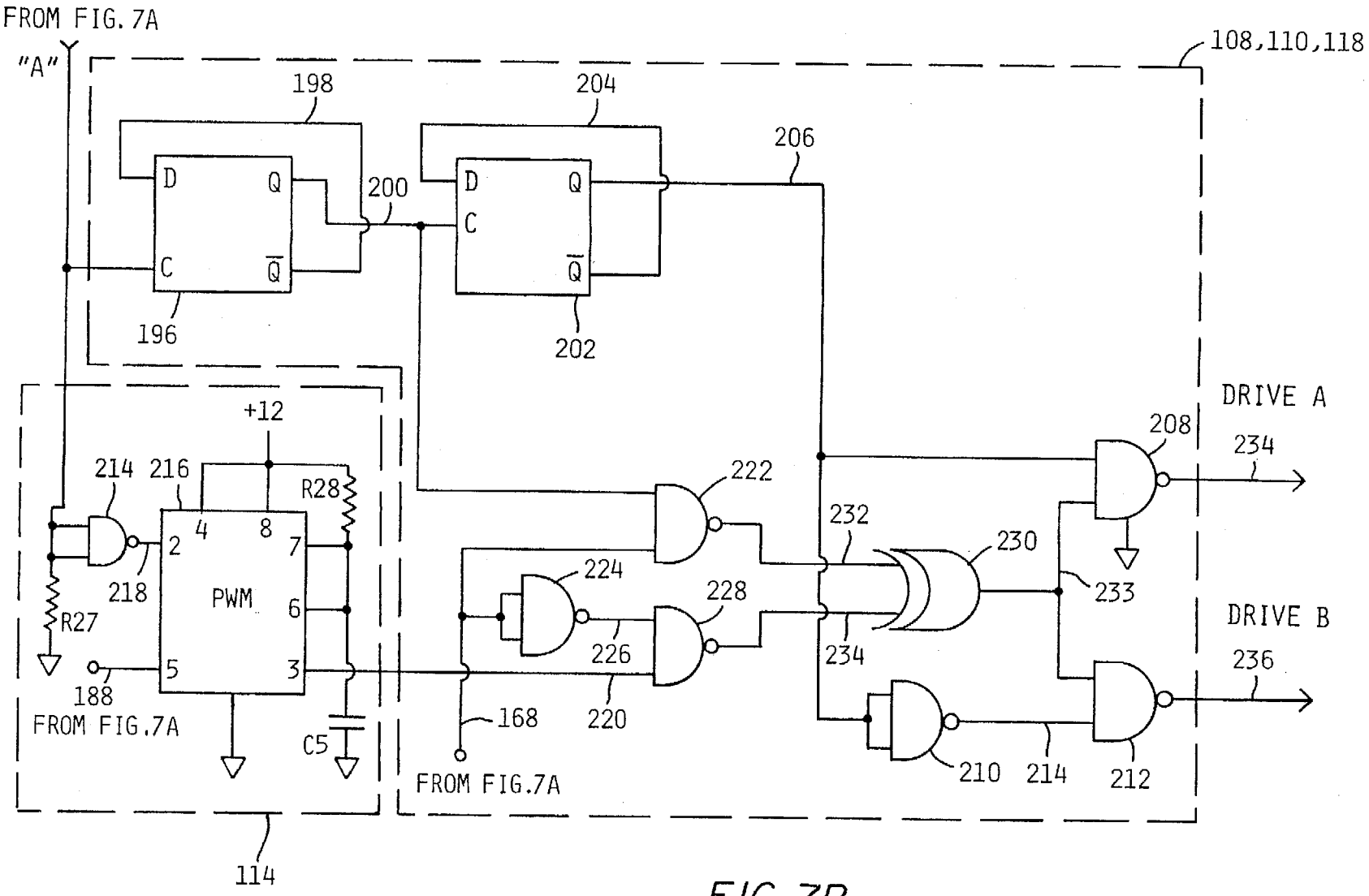
Figure 7C:
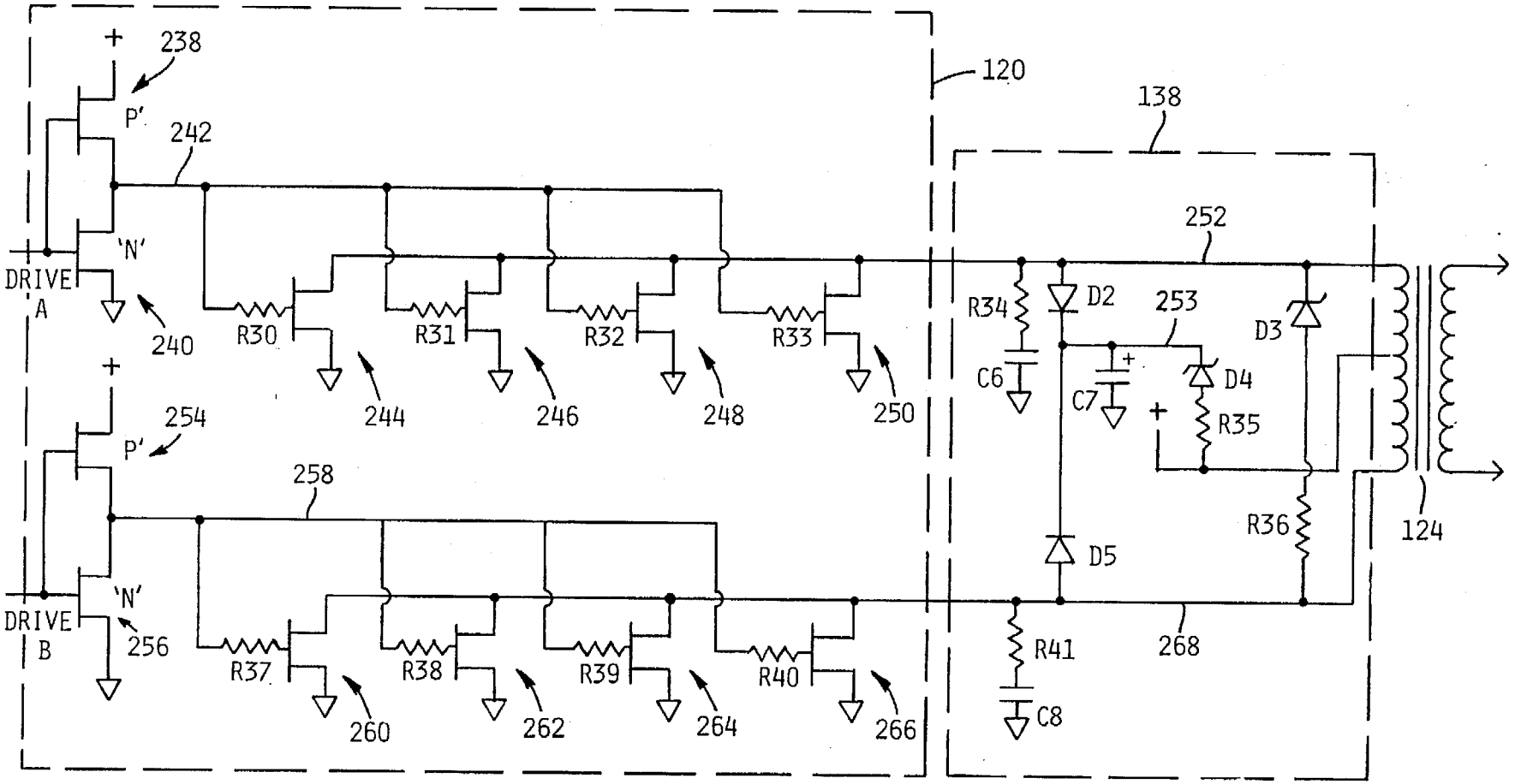

One specific implementation of the power delivering circuit shown in FIG. 6 is depicted in FIGS. 7A–7C. Those skilled in the art, however, will appreciate that many specific implementations of the functionality shown in FIG. 6 could be realized. For example, a programmable array logic (PAL) could readily be utilized. In one preferred embodiment, a PAL, manufactured by Altera, Model EP610PC-20T, with associated configuration software, provides the functionality for the duty cycle adjust circuitry 114, the symmetric square wave circuitry 108, the modulated square wave circuitry 110, and the selector circuitry 118 shown in FIG. 6. As shown in FIGS. 7A–7C, an input square wave signal having a frequency four times the desired operating frequency is supplied on a line 150 via a limiting resistor R10 and is provided to both inputs of a first NAND gate 152 via a line 154. An inverted square wave signal is then provided to the inputs of a second NAND gate 156 on a line 158. The NAND gate 156 provides an output square wave signal on a line 160 via limiting resistor R11 to the frequency input terminal of a frequency-to-voltage converter circuit 162 corresponding to functional block 104 in FIG. 6. The frequency-to-voltage circuit 162 provides an output voltage signal corresponding to the frequency of the input square wave signal on a line 164.

This signal on line 164 is applied to frequency discriminating circuitry for detecting very low frequency input signals and for detecting whether the frequency of the input signal exceeds the cross-over frequency. In order to provide a signal corresponding to detection of the cross-over frequency, the signal on line 164 is supplied via limiting resistor R14 to the noninverting input terminal of a first comparator 166. A feedback resistor R15 is placed between the noninverting input terminal and the output terminal of comparator 166. A threshold voltage corresponding to the cross-over frequency (425 Hz in the example shown) is applied to the inverting terminal of comparator 166 via the voltage divider circuit including resistors R16 and R17. Thus, when the voltage level corresponding to the frequency of the square wave input signal exceeds that of the threshold voltage, a signal appearing at the output terminal 168 appears as a constant high voltage.

The signal on line 164 is likewise applied via limiting resistor R18 to the inverting input terminal of a second comparator 170 for determining whether the frequency of the input signal exceeds a minimum value, for example 25 Hz. A feedback resistor R19 is placed between the output terminal and the inverting terminal of the comparator 170. A positive threshold voltage corresponding to a minimum frequency of operation is applied to the noninverting input terminal of comparator 170 through a voltage divider circuit including resistors R20–R22. Thus, when the magnitude of the voltage corresponding to the frequency of the input signal is less than the threshold voltage, a signal at the output terminal of comparator 170 will appear as a positive voltage. This signal is passed on a line 172 to the inputs of a NAND gate 174. The NAND gate 174 inverts this signal and passes the now inverted signal to one input of a NAND gate 176 via a line 178. The NAND gate 176 inhibits passage of the input signal on line 160 for low frequency signals less than 25 Hz.

In addition, the voltage signal on line 164 corresponding to the frequency of the input square wave signal is provided to circuitry for adjusting the duty cycle of the generated audio signal corresponding to block 114 in FIG. 6. The signal on line 164 is supplied via a resistor R23 to the noninverting input terminal of a first buffer amplifier 180. The inverting terminal of buffer 180 is coupled with the output terminal via a line 182. The buffer 180 passes an output voltage signal via resistor R24 to the noninverting terminal of a second buffer amplifier 184 on a line 186. The buffer 184 has its output terminal connected with the inverting input terminal via a line 188.

In addition, an offset voltage is applied to the noninverting input terminal of buffer 184. In particular, an offset voltage is applied to the noninverting input terminal of a third buffer amplifier 190 via a voltage divider circuit including resistor R25. The inverting input terminal of buffer 190 is connected to the output terminal via a line 192. Thus, the buffer 190 passes an offset voltage via a resistor R26 to the noninverting input terminal of buffer 184 on the line 186. Accordingly, a control signal indicative of desired duty cycle adjustment is generated at line 188 corresponding to the summation of the signal indicative of frequency of the input signal and an offset.

As noted above, the signal on line 160 corresponding to the input square wave signal and also the signal on line 178 corresponding to a low frequency signal are applied to the inputs of NAND gate 176. The NAND gate 176 logically NANDs these signals and provides an output signal on a line 194. In this way, very low frequency signals are inhibited.

As seen in FIG. 7B, the output signal on line 194 is provided to divider circuitry and particularly to the clock input of a first D-type flip-flop 196. The D input of flip-flop 196 is connected to the Q' output on a line 198. The Q output of flip-flop 196 provides an output signal having a frequency one-half the frequency of the input square wave signal on a line 200 to the clock input of a second flip-flop 202. The D input of flip-flop 202 is connected to the Q' output via a line 204. The flip-flop 202 provides an output signal having a frequency one fourth that of the frequency of the input square signal on a line 206. This signal is applied to one input of a NAND gate 208. In addition, the signal on line 206 is applied to the inputs of a NAND gate 210. NAND gate 210 provides an inverted signal to one input terminal of a further NAND gate 212 on a line 214.

The signal on line 194 is also applied to the inputs of a NAND gate 214. The NAND gate 214 inverts this signal and thereafter applies the signal to an input terminal of a pulse width modulator circuit 216 via a line 218. The pulse width modulator circuit 216 also receives a control signal on line 188. In response, the pulse width modulator circuit 216 supplies an output signal on a line 220.

In addition, the signal on line 168 corresponding to the selection of a fourth harmonic modulated or square waveshape is supplied to one input of a NAND gate 222. The other input of NAND gate 222 receives the signal corresponding to one-half the frequency of the input signal on line 200. The signal on line 168 is also applied to the input terminals of a NAND gate 224. In turn, NAND gate 224 supplies an inverted select signal on a line 226 to one input terminal of a NAND gate 228. NAND gate 228 receives its other input from the signal on line 220 corresponding to a duty cycle adjust signal. The outputs of NAND gates 222 and 228 are applied to the inputs of an XNOR gate 230 on lines 232 and 234, respectively. The XNOR gate 230 logically XNORs the input signals on lines 232 and 234 and provides an output signal on a line 233. This signal on line is logically NANDed with the signals on lines 206 and 214 corresponding to signals having one-fourth the frequency of the input signal, respectively, to provide positive and negative signals corresponding to the generated audio signal denoted by DRIVE A and DRIVE B on the lines 234 and 236, respectively.

FIG. 7C illustrates a suitable implementation for the blocks 120, 124, and 138 of FIG. 6 corresponding to the output amplifier section, transient suppression circuitry, and the output transformer of the power delivering circuit 100. The output signal on line 234 (from FIG. 7B) is applied to the gates of a pair of field effect transistors (FETs) 238 and 240. Transistor 238 is a P-channel FET having its source coupled to a constant positive voltage and its drain coupled to the source of transistor 240. Transistor 240 is an N-channel FET having its drain coupled to ground. The output of the FET transistor pair 238 and 240 is provided on a line 242 to four cascaded output N-channel FETs 244–250. In particular, the output signal on line 242 is supplied via limiting resistors R30–R33 to the gates of output transistors 244–250. The respective drains of output transistors 244–250 are coupled to ground. The respective sources of transistors 244–250 supply an amplified signal via a line 252 to a first input terminal of the primary winding of output transformer 124. Output transformer 124 is center-tapped, having its center coupled with a constant positive voltage. The transient suppression circuitry corresponding to block 138 of FIG. 6 includes snubber circuit including resistor R34 and capacitor C6 that provide protection for short duration, high amplitude transients. In addition, a protection circuit for long duration transient signals includes diode D2 coupled with capacitors C6 and diode D4 on a line 253. Diode D3 is connected via resistor R35 to the constant positive voltage. A transorb D3 and resistor R35 provide protection for fast transient signals.

The signal appearing on line 236 to drive B is supplied to the second terminal of the primary winding of transformer 124 in exactly the same fashion. The output signal on line 236 (from FIG. 7B) is applied to the gates of a pair of FETs 254 and 256. Transistor 254 is a P-channel FET having its source coupled to a constant positive voltage and its drain coupled to the source of transistor 256. Transistor 256 is an N-channel FET having its drain coupled to ground. The output of the FET transistor pair 254 and 256 is provided on a line 258 to four cascaded output N-channel FETs 260–266. In particular, the output signal on line 258 is supplied via limiting resistors R37–R40 to the respective gates of output transistors 260–266. The respective drains are coupled to ground. The respective sources of output transistors 260–266 supply an amplified signal on a line 268 to the second input terminal of the primary winding of output transformer 124. A snubber circuit including resistor R41 and capacitor C8 is placed between line 268 and ground. A diode D5 is placed between lines 268 and 253 to form part of the protection circuitry described above. Thus, an amplified output audio signal is applied by the output terminals of the secondary winding of output transformer 124 to the loudspeaker.

The power delivering circuit shown in FIGS. 7A–7C may have the following types and values for the circuit elements shown:

| Reference Numeral | Type, Value |
|---|---|
| R10 | 15 kohms |
| R11 | 1 kohms |
| R12 | 680 ohms |
| R13, R14, R16, R17, R18, R20, R21, R22, R23, R24, R25, R26 | 10 kohms |
| R15, R19 | 470 kohms |
| R27 | 47 kohms |
| 162 | LM 2917 |
| 216 | 555 |
| C3 | .0022 microfarad |
| C4 | 47 picofarads |
| C5 | .047 microfarads |

A novel tone generating circuit meeting the aforestated objectives has therefore been described. The circuit modulates fourth harmonic with its fundamental to supply an output signal to a loudspeaker. The tone generating circuit may be utilized in a power delivering circuit that supplies signals of varying waveshapes in different modes of operation. Of course, the invention is not limited to particular embodiments described herein since other embodiments of the principles of this invention will occur to those skilled in the art and familiar with the teachings of this application. For example, the signal processing described above may be achieved by several topologies including other discrete digital devices, analog/digital or microprocessor arrangements. Likewise, digital signal processing techniques are well suited for implementation of this invention.

What is claimed is:

1. A tone generating circuit for delivering power to a speaker comprising:

a first circuit for generating a first square wave audio signal having a first frequency;

a second circuit for generating a second square wave audio signal having a second frequency one fourth the first frequency;

a modulator circuit coupled with said first circuit and said second circuit for modulating the second square wave audio signal by the first square wave audio signal and for producing a modulated audio signal having a harmonic content at frequencies that match the frequencies of the harmonic content of the second square wave audio signal while having power added to the third and fifth harmonics of the second square wave audio signal; and an amplifier circuit coupled with the modulator circuit for receiving the modulated audio signal and for providing an output signal to the speaker.

2. The tone generating circuit of claim 1 wherein said second circuit is coupled with said first circuit, said second circuit including divider circuit means for receiving the first square wave signal from the first circuit and for providing the second square wave audio signal.

3. The tone generating circuit of claim 1 wherein the second frequency is less than one-third the –3 dB upper frequency limit of the speaker.

4. The tone generating circuit of claim 1 wherein the first frequency is less than four times the –3 dB point of the upper frequency limit of the speaker.

5. Apparatus for generating a siren tone comprising voltage controlled oscillator means for supplying a variable frequency signal;

divider circuit means coupled with said voltage controlled oscillator means for receiving the variable frequency signal, for dividing the variable frequency signal by a factor of four, and for supplying an audio signal;

modulation circuit means coupled with said voltage controlled oscillator means and said divider circuit means for amplitude modulating the audio signal by the variable frequency signal and for providing a modulated audio signal with a harmonic content with frequencies that match the frequencies of the harmonic content of the second square wave audio signal while having power added to the third and fifth harmonics of the audio signal; and output circuit means for receiving the modulated audio signal and for providing an output siren tone.

6. The apparatus of claim 5 wherein the variable frequency signal is a square wave.

7. The apparatus of claim 6 wherein the audio signal is a square wave.

8. The apparatus of claim 5 wherein said output circuit means comprises:

amplifier circuit means coupled with said modulation means for receiving the modulated audio signal and for providing an output signal; and a speaker cone coupled with said amplifier circuit means for receiving the output signal and for providing the siren tone.

9. The apparatus of claim 8 wherein said voltage controlled oscillator means continuously varies between a selected frequency range.

10. A power delivering circuit operable in various modes for increasing audio output in a loud speaker comprising square wave signal generating means for providing a square wave audio input signal;

a first circuit for receiving the square wave signal and for providing an amplitude modulated audio signal;

a second circuit for receiving the square wave input signal and for providing a square wave audio signal;

selector circuit means coupled with said first circuit and said second circuit for passing the modulated output signal in a first mode of operation when the square wave audio input signal is in a first frequency range and for passing the square wave output signal in a second mode of operation when the square wave audio input signal is in a second frequency range; and an output circuit coupled with said selector circuit means for receiving the modulated output signal in the first mode and the square wave output signal in the second mode and for providing an output signal.

11. The power delivering circuit of claim 10 further including:

a third circuit coupled with the square wave signal generating means and the selector circuit means for receiving the square wave input signal and for providing a control signal to the selector circuit means in a selected frequency range, said selector circuit means passing a pulse width modulated output signal to said output circuit in response to said control signal in a third mode of operation.

12. The power delivering circuit of claim 10 further comprising frequency sensing means coupled with said square wave generating means and said third circuit for receiving said square wave audio input signal from said square wave generating means and for providing a frequency sensing signal to said third circuit corresponding to the frequency of the audio input signal.

13. The power delivering circuit of claim 12 wherein said frequency sensing means is coupled with said first circuit for enabling said first circuit in the first mode of operation.

14. The power delivering circuit of claim 11 wherein said frequency sensing means is coupled with said second circuit for enabling said second circuit in the second mode of operation.

15. A speaker system for generating acoustic messages for the purpose of alerting listeners to a condition that requires their response, the system comprising:

a source of an input signal comprising a fundamental frequency and a plurality of discrete harmonic frequencies and a predetermined distribution of power among the fundamental and harmonic frequencies;

a pre-amplifier responsive to the input signal having at least first and second modes;

the first mode of the pre-amplifier providing an output signal that redistributes the power of the input signal among the fundamental and harmonic frequencies in order to generate a desired acoustic effect;

the second mode of the pre-amplifier providing an output signal that substantially maintains the predetermined distribution of power among the fundamental and harmonic frequencies;

a circuit for detecting one or more of the frequencies of the input signal and enabling the pre-amplifier in either the first or second mode, depending on the value of one or more of the frequencies detected by the circuit; and an amplifier for receiving the output signal from the pre-amplifier and providing an amplified output signal to a speaker.

16. A speaker system as set forth in claim 15 wherein the first mode of the pre-amplifier includes:

a circuit for generating an intermediate signal having a fundamental frequency that is a multiple of the fundamental frequency of the input signal; and a modulator receiving the input signal and the intermediate signal for modulating the input and intermediate signals in order to redistribute the power among the fundamental and harmonic frequencies of the input signal.

17. A speaker system as set forth in claim 16 wherein the second mode of the pre-amplifier includes a circuit for passing the input signal to the output signal substantially unchanged.

18. A speaker system as set forth in claim 16 wherein the second mode of the pre-amplifier includes a pulse-width modulation circuit responsive to the input signal for generating the output signal.

19. A speaker system as set forth in claim 16 wherein the pre-amplifier includes a third mode and the circuit for detecting one or more of the frequencies of the input signal enables the pre-amplifier in one of the first, second or third modes, depending on the value of one or more of the frequencies detected by the circuit, where the second mode includes a pulse-width modulation circuit responsive to the input signal for generating the output signal and the third mode includes a circuit for passing the input signal to the output signal substantially unchanged.

20. A speaker system as set forth in claim 17 wherein the input signal is a square wave signal.

21. A speaker system as set forth in claim 18 wherein the intermediate signal is four (4) times the input signal.

22. A speaker system as set forth in claim 17 wherein the redistributed power of the input signal is substantially added to the third and fifth harmonic frequencies at the expense of the fundamental frequency and the other harmonic frequencies.

23. A speaker system as set forth in claim 19 wherein the pre-amplifier operates in each of the first, second and third modes over respective first, second and third ranges of values of the fundamental frequency of the input signal such that each of the ranges of values is discrete from the others.

24. A speaker system as set forth in claim 23 wherein the first range of values of the fundamental frequency is less than the second range of values, which in turn is less than the third range of values.

25. A method for producing a tone in a speaker using a first audio signal generating circuit, a second audio signal generating circuit, and a modulator circuit, the method comprising the steps of:

generating a high frequency square wave signal with the first audio signal generating circuit;

generating a second square wave signal having a frequency of one-fourth the high frequency signal with the second audio signal generating circuit, the second signal corresponding to the frequency of the desired tone;

amplitude modulating the second signal by the first signal to produce a third signal, the third signal having at least a third and a fifth harmonic at frequencies that match the frequencies of the first and fifth harmonics of the second signal while having greater power in the third and fifth harmonics than that of the second signal; and providing the third signal to the speaker.

26. The method of claim 25 wherein the first signal is swept through a selected frequency range to produce a siren tone.

27. The method of claim 26 further including the step of amplifying the third signal and then providing the third signal to the speaker.

* * * * *